US007662325B2

(12) United States Patent
Iwata et al.

(10) Patent No.: US 7,662,325 B2
(45) Date of Patent: Feb. 16, 2010

(54) POLYHYDROXYALKANOIC ACID FIBERS WITH HIGH STRENGTH, FIBERS WITH HIGH STRENGTH AND HIGH MODULUS OF ELASTICITY, AND PROCESSES FOR PRODUCING THE SAME

(75) Inventors: Tadahisa Iwata, Wako (JP); Yoshiharu Doi, Wako (JP); Hideki Yamane, Moriyama (JP)

(73) Assignees: Riken, Saitama (JP); Japan Science and Technology Agency, Saitama (JP)

( * ) Notice: Subject to any disclaimer, the term of this patent is extended or adjusted under 35 U.S.C. 154(b) by 345 days.

(21) Appl. No.: 11/670,342

(22) Filed: Feb. 1, 2007

(65) Prior Publication Data

US 2007/0138688 A1 Jun. 21, 2007

Related U.S. Application Data

(62) Division of application No. 10/505,731, filed as application No. PCT/JP03/02352 on Feb. 28, 2003, now Pat. No. 7,241,495.

(30) Foreign Application Priority Data

Feb. 28, 2002 (JP) ..... 2002-54423
Feb. 28, 2002 (JP) ..... 2002-54428

(51) Int. Cl.
*D01D 5/12* (2006.01)

(52) U.S. Cl. ..... 264/210.5; 264/210.7; 264/210.8; 264/211.15; 264/211.17

(58) Field of Classification Search ..... 264/210.7, 264/211.17, 210.5, 210.8, 211.14, 211.15, 264/235.6, 290.5
See application file for complete search history.

(56) References Cited

U.S. PATENT DOCUMENTS 3,546,329 A * 12/1970 Hirono et al. ..... 264/235

(Continued)

FOREIGN PATENT DOCUMENTS

EP 0078609 A2 5/1983

(Continued)

OTHER PUBLICATIONS

Anderson et al., Microbiological Reviews, vol. 54, No. 4, pp. 450-472, (Dec. 1990).

(Continued)

*Primary Examiner*—Joseph S. Del Sole
*Assistant Examiner*—Robert Dye
(74) *Attorney, Agent, or Firm*—Birch, Stewart, Kolasch & Birch, LLP

(57) ABSTRACT

The present invention is a process for producing a fiber, comprising: melt-extruding polyhydroxyalkanoic acid; solidifying the polyhydroxyalkanoic acid by quenching it to its glass transition temperature +15° C. or less, to form an amorphous fiber; cold-drawing the amorphous fiber at its glass transition temperature +20° C. or less; and subjecting the fiber to heat treatment under tension. The present invention can provide: a process for producing a fiber with high strength, and the fiber produced through the process; and a process for producing a fiber with high strength and high modulus of elasticity and the fiber with high strength and high modulus of elasticity produced through the process, regardless of molecular weights of PHAs varying depending on origins such as a wild type PHAs-producing microorganism product, a genetically modified product, and a chemical product.

7 Claims, 1 Drawing Sheet

U.S. PATENT DOCUMENTS

| | | | | |
|---|---|---|---|---|
| 4,537,738 | A | | 8/1985 | Holmes |
| 4,792,336 | A | | 12/1988 | Hlavacek et al. |
| 5,191,037 | A | | 3/1993 | Doi et al. |
| 5,626,811 | A | * | 5/1997 | Liu ..... 264/210.7 |
| 5,917,002 | A | | 6/1999 | Doi et al. |

FOREIGN PATENT DOCUMENTS

| | | | | |
|---|---|---|---|---|
| EP | 1266984 | A1 | | 12/2002 |
| JP | 5-230732 | | * | 9/1993 |
| JP | 5-321025 | A | | 12/1993 |
| JP | 7-300720 | A | | 11/1995 |
| JP | 8-218216 | A | | 8/1996 |
| JP | 10-176076 | | | 6/1998 |
| JP | 2000-192370 | A | | 7/2000 |
| JP | 2003-27345 | A | | 1/2003 |

OTHER PUBLICATIONS

Gordeyev et al., Journal of Materials Science Letters, vol. 18, pp. 1691-1692, (1999).

Schmack et al , Journal of Polymer Science; Polymer Physics. vol. 38, pp. 2841-2850, (2000).

Yamane et al., Polymer 42, pp. 3241-3248, (2001).

* cited by examiner

POLYHYDROXYALKANOIC ACID FIBERS WITH HIGH STRENGTH, FIBERS WITH HIGH STRENGTH AND HIGH MODULUS OF ELASTICITY, AND PROCESSES FOR PRODUCING THE SAME

This application is a Divisional of co-pending application Ser. No. 10/505,731 filed on Aug. 26, 2004 and for which priority is claimed under 35 U.S.C. § 120. Application Ser. No. 10/505,731 is the national phase of PCT International Application No. PCT/JP03/02352 filed on Feb. 28, 2003 under 35 U.S.C. § 371. The entire contents of each of the above-identified applications are hereby incorporated by reference.

TECHNICAL FIELD

The present invention relates to a fiber produced from polyhydroxyalkanoic acids (hereinafter, may also be referred to as "PHAs") as a raw material and a process for producing the same. The invention more specifically relates to a fiber with high strength having high breaking strength and a process for producing the same, and a fiber with high strength and high modulus of elasticity having high breaking strength and high Young's modulus and a process for producing the same.

BACKGROUND ART

Polyhydroxyalkanoic acids are biodegradable and biocompatible, and their use for various molded products such as fibers or films has been studied.

A fiber produced from PHAs as a raw material is biodegradable and biocompatible, and thus, a great demand can be anticipated for the fiber as: medical equipment such as surgical sutures; fishery equipment such as fishing lines and fishing nets; clothing materials such as fibers; construction materials such as nonwoven fabrics and ropes; packaging materials for food or the like; etc.

Poly(3-hydroxybutanoic acid) (hereinafter, may also be referred to as "P(3HB)") among PHAs is known to be synthesized by many microorganisms as an intracellular reserve substance and be accumulated in a form of granules in cytoplasm (Nonpatent Document 1).

Further, the inventors of the present invention have succeeded in obtaining P(3HB) with remarkably enhanced molecular weight using genetically modified *Escherichia coli* of a poly(3-hydroxybutanoic acid) synthesis gene compared to that obtained using a wild type P(3HB)-producing microorganism (Patent Document 1).

P(3HE) obtained from the P(3HB)-producing microorganism is expected to be a raw material for biodegradable products.

Fibers produced from P(3HB) as a raw material hitherto have been produced through a process involving: melt-extruding P(3HB) having a weight average molecular weight of about 600,000 (number average molecular weight of about 300,000) as a raw material; hot drawing the P(3HB); and subjecting the P(3HB) to heat treatment. A specific example of such a process described in Nonpatent Document 2 involves: purifying P(3HB) having a weight average molecular weight of 300,000 with chloroform; melt-extruding the P(3HB) in four stages of melting temperature zones (170° C.-175° C.-180° C.-182° C.); drawing the P(3HB) to a draw ratio of 800% at 110° C.; and maintaining the temperature at 155° C. for 1 hour to crystallize the P(3HB), to thereby form a fiber. Physical properties of the obtained fiber include a breaking strength of 190 MPa, an elongation to break of 54%, and a Young's modulus of 5.6 GPa. Further, Nonpatent Document 3 describes a process involving: forming pellets having a viscosity average molecular weight of 360,000 once without purifying P(3HB) having a viscosity average molecular weight of 540,000; melt-extruding the pellets at 173° C.; winding at a wind rate of 2,000 to 3,500 m/min or 250 m/min; drawing to a draw ratio of 400% or 690% at 40 to 60° C.; and maintaining the temperature at 40 to 60° C. to crystallize, to thereby form a fiber. The physical properties of the obtained fiber include a breaking strength of 330 Mpa, an elongation to break of 37%, and a Young's modulus of 7.7 GPa.

However, the fibers do not have physical properties comparable to those of the general polymers and are not in practical use.

Meanwhile, Nonpatent Document 4 describes a process involving: melt-extruding non-purified P(3HB) granules at a melting temperature of 180° C. and a nozzle temperature of 170° C.; winding at a wind rate of 28 m/min; drawing to a draw ratio of 600% at 110° C.; and maintaining under tension of 0 MPa, 50 MPa, and 100 MPa at 75, 100, 125, and 150° C. for 2.5 minutes to crystallize, to thereby form a fiber. The obtained fiber has a breaking strength of 310 MPa, an elongation to break of 60%, and a Young's modulus of 3.8 GPa.

However, a fiber with high strength, a fiber with high strength and high modulus of elasticity produced from P(3HB) as a raw material having any molecular weight including purified P(3HB) and P(3HB) having a high weight average molecular weight of 600,000 or more, and a process for producing the same have not been found.

Thus, developments of processes for producing a fiber with high strength and a fiber with high strength and high modulus of elasticity having improved physical properties while retaining biodegradability from various PHAs as a raw material including PHAs of a wild type PHA-producing microorganism have been desired.

<Nonpatent Document 1>
Anderson, A. J. and Dawes, E. A, Microbiol. Rev. 54: 450-472 (1990)

<Nonpatent Document 2>
Gordeyev et al., J. Mater. Sci. Lett., 18, 1691 (1999)

<Nonpatent Document 3>
Schmack et al., J. Polym, Sci. Poylm. Phys. Ed., 38, 2841 (2000)

<Nonpatent Document 4>
Yamane et al., Polymer, 42, 3241 (2001)

<Patent Document 1>
JP 10-176070 A

DISCLOSURE OF THE INVENTION

An object of the present invention is to provide: a process for producing a fiber with high strength, and the fiber with high strength produced through the process; and a process for producing a fiber with high strength and high modulus of elasticity and the fiber with high strength and high modulus of elasticity produced through the process, regardless of molecular weight or the like of PHAs varying depending on origins such as a wild type PHAs-producing microorganism product, a genetically modified product, and a chemical product.

The inventors of the present invention have found through intensive studies that the above-described object can be solved by melt-extruding polyhydroxyalkanoic acid, solidifying the polyhydroxyalkanoic acid by quenching it to its glass transition temperature +15° C. to form an amorphous fiber, cold-drawing the amorphous fiber at its glass transition temperature +20° C. or less, subjecting the amorphous fiber to heat treatment under tension in a single stage or multiple stages, and further drawing the fiber at a glass transition temperature or more after the cold-drawing, and thus, have completed the present invention.

That is, the gist of the present invention is as follows.

(1) A process for producing a fiber, characterized by including: melt-extruding polyhydroxyalkanoic acid; solidifying the polyhydroxyalkanoic acid by quenching it to its glass transition temperature +15° C. or less, to form an amorphous fiber; cold-drawing the amorphous fiber at its glass transition temperature +20° C. or less; and subjecting the fiber to heat treatment under tension.

(2) A process for producing a fiber according to the above item (1), wherein the heat treatment is carried out in multiple stages.

(3) A process for producing a fiber according to the above item (2), wherein the heat treatment of each stage is carried out at a temperature higher than a temperature of a previous stage.

(4) A process for producing a fiber according to any one of the above items (1) to (3), wherein the heat treatment is carried out under tension using two wind-up rollers.

(5) A process for producing a fiber according to any one of the above items (1) to (4), further including drawing the fiber at a glass transition temperature or more after the cold-drawing.

(6) A process for producing a fiber according to the above item (5), wherein the drawing the fiber at a glass transition temperature or more is carried out in multiple stages or two or more stages.

(7) A process for producing a fiber according to the above item (6), wherein the drawing the fiber at a glass transition temperature or more of each stage is carried out at a temperature higher than a temperature of a previous stage.

(8) A process for producing a fiber according to any one of the above items (1) to (7), wherein the cold-drawing is carried out under tension using two wind-up rollers.

(9) A process for producing a fiber according to any one of the above items (1) to (8), wherein the polyhydroxyalkanoic acid is poly(3-hydroxybutanoic acid).

(10) A fiber produced by: melt-extruding polyhydroxyalkanoic acid; solidifying the polyhydroxyalkanoic acid by quenching it to its glass transition temperature +15° C. or less, to form an amorphous fiber; cold-drawing the amorphous fiber at its glass transition temperature +20° C. or less; and subjecting the fiber to heat treatment under tension, wherein the fiber has a breaking strength of 350 MPa or more.

(11) A fiber produced by: melt-extruding polyhydroxyalkanoic acid; solidifying the polyhydroxyalkanoic acid by quenching it to its glass transition temperature +15° C. or less, to form an amorphous fiber; cold-drawing the amorphous fiber at its glass transition temperature +20° C. or less; and subjecting the fiber to heat treatment under tension in multiple stages, wherein the fiber has a breaking strength of 350 MPa or more.

(12) A fiber produced by: melt-extruding polyhydroxyalkanoic acid; solidifying the polyhydroxyalkanoic acid by quenching it to its glass transition temperature +15° C. or less, to form an amorphous fiber; cold-drawing the amorphous fiber at its glass transition temperature +20° C. or less; further drawing the fiber at a glass transition temperature or more; and subjecting the fiber to heat treatment under tension, wherein the fiber has a breaking strength of 350 MPa or more and a Young's modulus of 2 GPa or more.

Hereinafter, embodiment modes of the present invention will be described.

(1) Process for Producing Fiber of the Present Invention (i) PHAs Employed in the Present Invention In a production process of the present invention, polyhydroxyalkanoic acids are employed as fiber molding materials. Preferable examples of polyhydroxyalkanoic acid include polyhydroxybutanoic acid (hereinafter, also referred to as "PHB"). Processes for obtaining PHB include fermentation synthesis and chemical synthesis in general. Chemical synthesis is a process for chemically synthesizing PHB following a general organic synthesis technique and results in a mixture (racemate) of poly[(R)-3-hydroxybutanoic acid] and poly[(S)-3-hydroxybutanoic acid]. In contrast, fermentation synthesis involves culturing a microorganism capable of producing PHB and collecting PHB accumulated in the cells. PHB produced through fermentation synthesis is a poly[(R)-3-hydroxybutanoic acid] homopolymer.

A microorganism that can be used for fermentation synthesis is not particularly limited as long as it is a microorganism capable of producing PHB. PHB is known to accumulate in microbial cells of 60 or more species of naturally occurring microorganisms including those belonging to the genus *Alcaligenes* such as *Ralstonia eutropha, Alcaligenes latus*, and *Alcaligenes faecalis*. Examples of microorganisms for producing high molecular weight PHB having a weight average molecular weight of 1,000,000 (number average molecular weight of 500,000) or more include strains of microbial species belonging to the genus *Methylobacterium*, more specifically, *Methylobacterium extorquens* ATCC55366 (Bourque, D. et al., Appl. Microbiol. Biotechnol. (1995)). The strains are commercially available from American Type Culture Collection (ATCC).

In the fermentation synthesis, the microorganisms are generally cultured in a usual medium containing a carbon source, a nitrogen source, inorganic ions, and if necessary, other organic components, to thereby accumulate PHB in the cells. PHB can be collected from the microbial cells through processes including extraction with an organic solvent such as chloroform, and degradation of the microbial components with an enzyme such as lysozyme followed by collecting PHB granules by filtration.

Further, a mode of the fermentation synthesis includes a process for culturing a microorganism transformed by introduction of a recombinant DNA containing a PHB synthesis gene and collecting PHB produced in the microbial cells. This process differs from culturing of *Ralstonia eutropha* or the like as it is, and the microorganisms transformed by introduction of a recombinant DNA have no PHB depolymerase, and thus, PHB having remarkably high molecular weight can be accumulated.

As such a transformed strain, for example, JP 10-176070 A discloses transformant *Escherichia coli* XL1-Blue (pSYL105) obtained by introducing plasmid pSYL105 containing a PHB synthesis gene phbCAB of *Ralstonia eutropha* into *Escherichia coli* XL1-Blue. Further, the transformant *Escherichia coli* XL1-Blue (pSYL105) is available from Stratagene Cloning Systems, Inc. (11011 North Torrey Pines Road, La Jolla, Calif. 92037, USA).

A transformant is cultured in an appropriate medium, and PHB is accumulated in the cells. A medium used include a usual medium containing a carbon source, a nitrogen source, inorganic ions, and if necessary, other organic components. When *Escherichia coli* is used, glucose or the like is used as a carbon source, and yeast extract, tryptone, or the like derived from natural substances is used as a nitrogen source. In addition, the medium may contain an inorganic nitrogen compound or the like such as an ammonium salt. The culture is preferably carried out under aerobic conditions for 12 to 20 hours, at a culture temperature of 30 to 37° C., and at pH of 6.0 to 8.0. PHB can be collected from the microbial cells through processes including extraction with an organic solvent such as chloroform, and degradation of the microbial components with an enzyme such as lysozyme followed by collecting PHB granules by filtration. To be specific, PHB can be extracted from dried microbial cells, which are separated and collected from a culture solution, with an appropriate poor solvent followed by precipitating using a precipitant.

Commercially available polyhydroxyalkanoic acids can be used as PHAs used for the present invention.

A molecular weight of the polyhydroxyalkanoic acids used in the present invention is not particularly limited as long as an effect of the present invention is not impaired. A weight average molecular weight of the polyhydroxyalkanoic acids is preferably 400,000 (number average molecular weight of 200,000) or more. An upper limit for the weight average molecular weight is not particularly limited, but is preferably 4,000,000 (number average molecular weight of 2,000,000) or less, particularly preferably 1,000,000 (number average molecular weight of 500,000) or less, for availability and moldability.

The polyhydroxyalkanoic acids used in the present invention may employ granules containing PHAs without purification and polymers purified from the granules through a purification process described below or the like.

(ii) Production Process of the Present Invention

In the process of the present invention, a fiber is produced by: melt-extruding the above-described PHAs; solidifying the PHAs by quenching it to their glass transition temperature +15° C. or less, to thereby form an amorphous fiber; cold-drawing the amorphous fiber at their glass transition temperature +20° C. or less; and subjecting the fiber to heat treatment under tension.

PHAs can be melt-extruded using a general plastic fiber melting technique and involves, for example, heating, melting, loading, and extruding the PHAs from an extrusion opening.

PHAs are generally melt-extruded at a melting point or more of polyhydroxyalkanoic acid to be melted, preferably a melting point thereof +10° C. or more, more preferably a melting point thereof +15 to 20° C. The melting point of PHB is 175° C.

The molten polyhydroxyalkanoic acid is extruded into a cooling medium at its glass transition temperature +15° C. or less, preferably its glass transition temperature +10° C. or less, more preferably a glass transition temperature or less and quenched for fiber formation. A lower limit for the temperature of the quenching and fiber formation is not particularly limited, but is generally −180° C. or more for economical reasons. The molten polyhydroxyalkanoic acid forms into a morphous fibers through the quenching step. The obtained fiber can be wound in a cooling medium. The glass transition temperature can be evaluated through dynamic viscoelasticity measurement, for example. Dynamic viscoelasticity can be measured by, for example, using DMS210 (manufactured by Seiko Instruments & Electronics Ltd.) in a range of −100 to 120° C. under the conditions of nitrogen atmosphere, a frequency of 1 Hz, and a temperature increase rate of 2° C./min. A low molecular weight PHB has a glass transition temperature of 4° C. or less. A high molecular weight PHB has a glass transition temperature of 10° C. or less. Even higher molecular weight PHB has a glass transition temperature of 20° C. or less. Higher glass transition temperature is useful for easy processing.

Examples of the cooling medium include air, water (ice water), and an inert gas. In the present invention, the quenching may be carried out by, for example, extruding the molten polyhydroxyalkanoic acid into air or ice water at its glass transition temperature +15° C. or less and allowing the molten polyhydroxyalkanoic acid to pass through the solvent while winding. A wind rate is 3 to 150 m/min, preferably 3 to 30 m/min.

An amorphous fiber can be confirmed through processes such as X-ray diffraction, for example. No peaks assigned to crystals in X-ray diffraction indicate that the fiber is amorphous.

The obtained amorphous fiber is subjected to cold-drawing. The cold-drawing is carried out at preferably a glass transition temperature +20° C. or less, more preferably a glass transition temperature +10° C. or less, even more preferably a glass transition temperature or less. A lower limit for the temperature of the cold-drawing is not particularly limited, but is generally −180° C. or more for economical reasons. The drawing may be carried out under tension by, for example, fixing a fiber onto a drawing machine or the like and preferably winding using two wind-up rollers (two roll set) or the like. When a fiber is fixed onto a drawing machine or the like, a draw ratio is generally 200% or more, preferably 400% or more. An upper limit for the draw ratio is not particularly limited, and only needs to be smaller than a ratio causing breaking of a fiber. A drawing time is generally 1 to 10 seconds, and the drawing time can be determined according to the draw ratio. When a fiber is drawn while being wound using a wind-up roller, a draw ratio is generally 300% or more, preferably 600% or more. An upper limit for the draw ratio is not particularly limited, and only needs to be smaller than a ratio causing breaking of a fiber. When a fiber is drawn while being wound using a wind-up roller, a drawing time is not particularly limited and may be within a range of a common procedure.

After the drawing, the fiber is subjected to heat treatment under tension. The heat treatment under tension may include warm air heat treatment and dryer heat treatment. In the heat treatment under tension, tension may be applied by fixing, loading, or stretching, for example. Fixing heat treatment refers to heat treatment of a fiber with its both ends fixed. When a fiber is loaded with a weight hung from one end thereof in heat treatment, the load is preferably as heavy as possible as long as the fiber does not break. The load can be determined within a range smaller than a load causing breaking of a drawn fiber. A load of 0 g refers to a load not stretching a fiber. Further, when a fiber is subjected to heat treatment under tension using a wind-up roller, tension may be applied by varying feed and wind rates. The fiber is subjected to heat treatment and drawing under tension. A fiber can be subjected to heat treatment under tension using a wind-up roller to a draw ratio of generally 0% or more, preferably 300% or more. A draw ratio of 0% refers to drawing so that the fiber does not stretch. An upper limit for the draw ratio is not particularly limited, and only needs to be smaller than a ratio not causing breaking of a fiber. When a fiber is drawn while being wound using a wind-up roller, a drawing time is not particularly limited and may be within a range of a common procedure.

In the process of the present invention, the heat treatment may be carried out in a single stage or multiple stages of two or more stages.

First stage of heat treatment may be carried out at generally 50 to 110° C., preferably 60 to 80° C. Single stage heat treatment may be carried out for generally 5 seconds to 10 minutes, preferably 1 second to 1 minute.

Second stage of heat treatment may be carried out at generally 50 to 110° C., preferably 70 to 90° C. A temperature of each heat treatment is preferably higher than a temperature of the previous stage, and is generally +5° C. or more of the previous stage, preferably +10° C. or more of the previous stage. An upper limit for the temperature of each stage is not particularly limited, and is generally a melting point or less. Heat treatment of second or latter stages is carried out for generally 5 seconds to 10 minutes, preferably 10 seconds to 1 minute.

According to another process of the present invention, a fiber is produced by: melt-extruding the above-described PHAs; solidifying the PHAs by quenching it to their glass transition temperature +15° C. or less, to thereby form an amorphous fiber; cold-drawing the amorphous fiber at their glass transition temperature +20° C. or less; further drawing the fiber at a glass transition temperature or more; and subjecting the fiber to heat treatment under tension.

The drawing the fiber at a glass transition temperature or more is carried out at a glass transition temperature or more, preferably at a glass transition temperature +5° C. or more, more preferably a glass transition temperature +10° C. or more. An upper limit for the temperature of the drawing the fiber at a glass transition temperature or more is not particularly limited, and generally can be carried out at a melting point or less. The drawing can be carried out by, for example, stretching and fixing. When a fiber is fixed to a drawing machine or the like, a draw ratio is generally 200% or more, preferably 400% or more. A drawing time is generally 1 to 10 seconds, and the drawing time can be determined according to the draw ratio.

In the process of the present invention, the drawing after the cold-drawing can be conducted in a single stage or multiple stages or two of more stages.

A temperature of each heat treatment is preferably higher than a temperature of the previous stage, and is generally +5° C. or more of the previous stage, preferably +10° C. or more of the previous stage. An upper limit for the temperature of each stage is not particularly limited, and is generally a melting point or less.

Fiber formation from low molecular PHB having a weight average molecular weight of about 600,000 (number average molecular weight of about 300,000) has been reported, but the fiber hardly had physical properties comparable to those of the general polymers. In addition, no reports are available on application of such a process to high molecular PHB having a weight average molecular weight of 600,000 (number average molecular weight of 300,000) or more. However, the process of the present invention can provide a fiber with high strength regardless of the molecular weight and purification of PHB.

Further, multiple stage heat treatment can provide a fiber with even higher strength. Further drawing the fiber at a glass transition temperature or more after the cold-drawing can provide a fiber with high strength and high modulus of elasticity.

(2) Fiber of the Present Invention

The fiber of the present invention is produced by: melt-extruding the PHAs; solidifying the PHAs by quenching it to their glass transition temperature +15° C. or less, to thereby form an amorphous fiber; cold-drawing the amorphous fiber at their glass transition temperature +20° C. or less; and subjecting the fiber to heat treatment under tension. A preferable mode of the fiber produced through the above-described process has such a feature that breaking strength is 350 MPa or more.

The term "breaking strength" used herein refers to a value measured in accordance with JIS-K-6301. The fiber of the present invention has a breaking strength of 350 MPa or more, preferably 400 MPa or more.

Further, the fiber of the present invention is produced by: melt-extruding PHAs; solidifying the PHAs acid by quenching it to their glass transition temperature +15° C. or less, to thereby form an amorphous fiber; cold-drawing the amorphous fiber at their glass transition temperature +20° C. or less; and subjecting the fiber to heat treatment under tension in multiple stages. A preferable mode of the fiber produced through the above-described process has such a feature that breaking strength is 350 MPa or more, preferably 400 MPa or more.

Further, the fiber of the present invention has flexibility comparable or superior to the conventional general polymers. For example, the fiber has a Young's modulus of 2 GPa or more, preferably 4 GPa or more, more preferably 5 GPa or more.

The fiber of the present invention is produced by: melt-extruding PHAs; solidifying the PHAs by quenching it to their glass transition temperature +15° C. or less, to thereby form an amorphous fiber; cold-drawing the amorphous fiber at their glass transition temperature +20° C. or less; further drawing the fiber at a glass transition temperature or more; and subjecting the fiber to heat treatment under tension. A preferable mode of the fiber is characterized in that the fiber produced through the above-described process has a breaking strength of 350 MPa or more and a Young's modulus of 2 GPa or more.

The term "breaking strength" used herein refers to a value measured in accordance with JIS-K-6301. The fiber of the present invention has a breaking strength of 350 MPa or more, preferably 400 MPa or more. The term "Young's modulus" used herein refers to a value measured in accordance with JIS-K-6301. The fiber of the present invention has a Young's modulus of 2 GPa or more, preferably 4 GPa or more, more preferably 6 GPa or more.

The fiber of the present invention is an oriented crystalline fiber in which the orientation of a crystalline portion of the PHAs fiber is in one direction. Most of the fibers produced from low molecular weight PHAs as a raw material through a conventional production process hardly had physical properties comparable to those of the general polymer fibers. Further, such a conventional production process had not been applied to high molecular weight PHAs having a weight average molecular weight of 600,000 (number average molecular weight of 300,000) or more. However, the present invention can provide an oriented crystalline fiber having physical properties comparable to those of the general polymer fibers regardless of the molecular weight.

Examples of materials that may be used for fiber formation according to the present invention include various additives usually used for forming a fiber such as a lubricant, an ultraviolet absorbing agent, a weathering agent, an antistatic agent, an antioxidant, a heat stabilizer, a nucleus agent, a fluidity-improving agent, and a colorant, in addition to the above-described PHAs.

The fiber of the present invention has sufficient strength and flexibility as described above and is made of PHAs which are excellent in biodegradability and biocompatibility. Thus, the fiber of the present invention is useful for: medical equipment such as surgical sutures; fishery equipment such as fishing lines and fishing nets; clothing materials such as fibers; construction materials such as nonwoven fabrics and ropes; packaging materials for food or the like; etc.

BEST MODE FOR CARRYING OUT THE INVENTION

Figure 1:
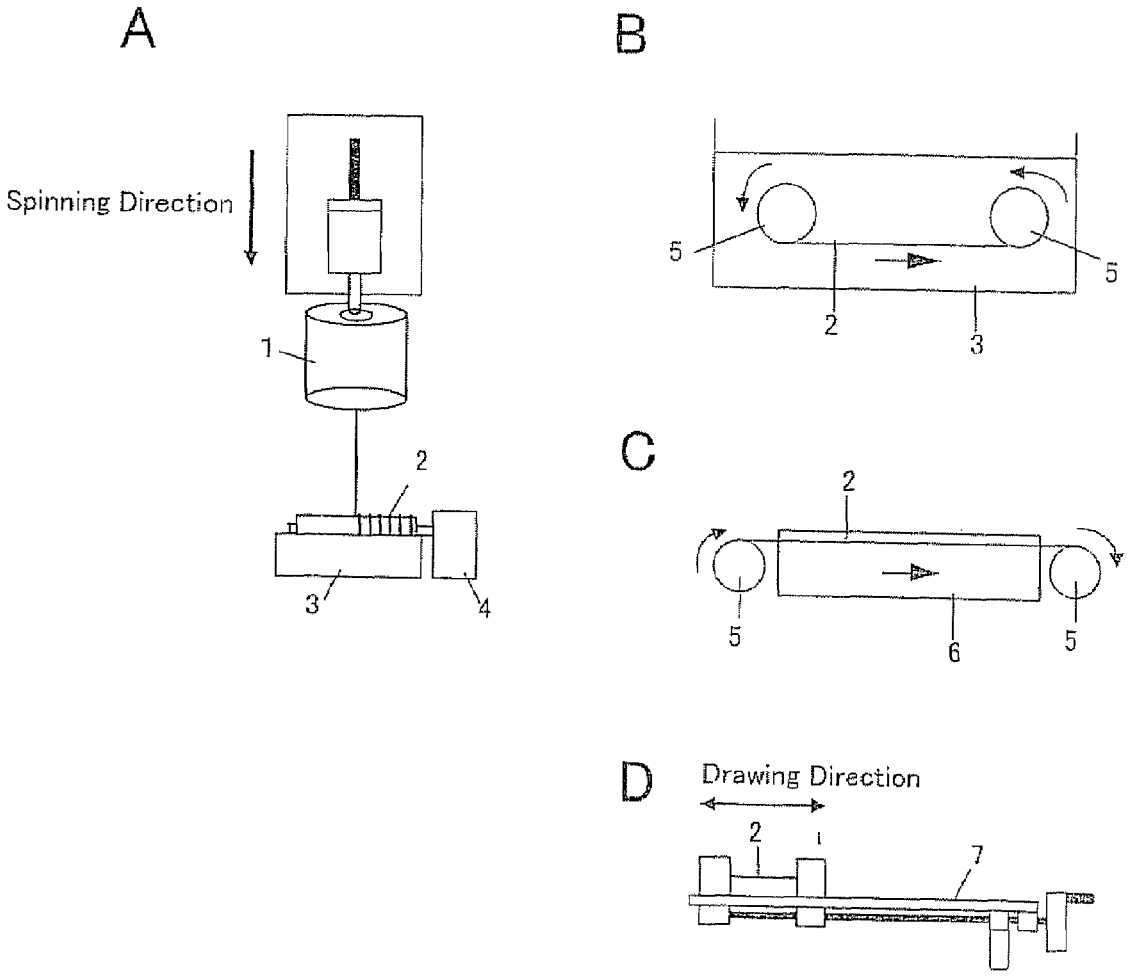
FIG. 1A is a schematic diagram showing processes of melt-extrusion and winding in ice water
FIG. 1B is a schematic diagram showing a process of drawing in ice water using a two roll set (two wind-up rollers).
FIG. 1C is a schematic diagram showing a process of drawing heat treatment using a two roll set (two wind-up rollers).
FIG. 1D is a schematic diagram showing two stage drawing using a drawing machine.

Hereinafter, the present invention will be described in more detail, but the present invention is not limited to the examples without departing from the scope of the invention.

EXAMPLES 1 TO 8

The experiment employed granules containing P(3HB) having a weight average molecular weight of 400,000 (number average molecular weight of 200,000) produced from *Ralstonia eutropha* which is a wild type PHB-producing microorganism. The granules were purchased from Monsanto Japan Limited. The granules were used without purification, or polymers purified from the granules by extraction with chloroform were used. Genetically modified *Escherichia coli* XL1-Blue (pSYL105) was prepared and cultured following a process described in JP 10-176070 A, and was purified to obtain PHB from the microbial cells followed by filtration of the granules. The weight average molecular weight of the obtained PHB measured following a process described in JP 10-176070 A was in 3,000,000 (number average molecular weight of 1,500,000).

PHB granules and polymers were melted at 220° C., extruded into air (20° C.) or ice water (3° C.) from an extrusion opening at an extrusion load of 53 g, and quenched for fiber formation. The obtained fibers were wound in air (20° C.) or in ice water (3° C.). FIG. 1A is a schematic diagram showing an example of a device used for the operation. The PHB granules and polymers were melted under heating with a heater 1 and extruded into an ice water bath 3. An obtained fiber 2 was wound using a roller 4. An extruder bore used was 1 mm. A wind rate was set to 6 m/min. Table 1 shows the success and failure of fiber formation.

The results show that fiber formation is possible by quenching at a glass transition temperature +15° C. or less, regardless of the molecular weight and purification of PHB.

TABLE 1

Success and failure of fiber formation after melt-extrusion of samples

| | Synthesis microorganism | Sample form | Purification | Weight average molecular weight | Number average molecular weight | winding conditions | Success or failure |
|---|---|---|---|---|---|---|---|
| Example 1 | Wild type strain | Granules | x | 400,000 | 200,000 | Room temperature (20° C.) | x |
| Example 2 | Wild type strain | Granules | x | 400,000 | 200,000 | In ice water (3° C.) | ○ |
| Example 3 | Wild type strain | Polymer | ○ | 400,000 | 200,000 | Room temperature (20° C.) | x |
| Example 4 | Wild type strain | Polymer | ○ | 400,000 | 200,000 | In ice water (3° C.) | ○ |
| Example 5 | Genetically modified *Escherichia coli* | Granules | x | 3,000,000 | 1,500,000 | Room temperature (20° C.) | ○ |
| Example 6 | Genetically modified *Escherichia coli* | Granules | x | 3,000,000 | 1,500,000 | In ice water (3° C.) | ○ |
| Example 7 | Genetically modified *Escherichia coli* | Polymer | ○ | 3,000,000 | 1,500,000 | Room temperature (20° C.) | ○ |
| Example 8 | Genetically modified *Escherichia coli* | Polymer | ○ | 3,000,000 | 1,500,000 | In ice water (3° C.) | ○ |

EXAMPLES 9 TO 14

Fibers were formed in the same manner as in Examples 1 to 8 except that purified PHB was used as a raw material and extruded into ice water for fiber formation.

The obtained fibers were set on a drawing machine and drawn to a draw ratio of 200 to 1,000% for 2 to 10 seconds, or drawn using a two roll set to a draw ratio of 600 to 1,000% at room temperature (20° C.) or in ice water (3° C.), FIG. 1B is a schematic diagram showing an example of the two roll set used for the operation. The fiber 2 being wound on a wind-up roller 5 is drawn while being wound on the other roller 5 in the ice water bath 3. The fiber can be drawn to a desired draw ratio by changing rates of the two wind-up rollers in such a device. Table 2 shows success and failure of drawing The results show that the fibers formed by quenching to a glass transition temperature +15° C. or less can be drawn using a drawing machine and a two roll set at a glass transition temperature +20° C. or less, regardless of the molecular weight of PHB.

TABLE 2

Success and failure of drawing after amorphous fiber formation of melt-extruded fiber in ice water

| | Weight average molecular weight | Number average molecular weight | Drawing process (1) | Drawing temperature | Success and failure of drawing |
|---|---|---|---|---|---|
| Example 9 | 400,000 | 200,000 | Drawing machine | Room temperature (20° C.) | ○ |
| Example 10 | 400,000 | 200,000 | Drawing machine | In ice water (3° C.) | ○ |
| Example 11 | 3,000,000 | 1,500,000 | Drawing machine | Room temperature (20° C.) | ○ |
| Example 12 | 3,000,000 | 1,500,000 | Drawing machine | In ice water (3° C.) | ○ |
| Example 13 | 3,000,000 | 1,500,000 | two roll set | Room temperature (20° C.) | ○ |

TABLE 2-continued

Success and failure of drawing after amorphous fiber formation of melt-extruded fiber in ice water

| | Weight average molecular weight | Number average molecular weight | Drawing process (1) | Drawing temperature | Success and failure of drawing |
|---|---|---|---|---|---|
| Example 14 | 3,000,000 | 1,500,000 | two roll set | In ice water (3° C.) | ○ |

(1): Spinning using two roll set, in ice water, feed rate of 50 rpm, draw winding at wind rate of 300 to 500 rpm

COMPARATIVE EXAMPLE 1, EXAMPLES 15 TO 20

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 220° C. and PHB was extruded into ice water for fiber formation.

The fibers obtained in Examples 15 to 20 were set on a drawing machine and were each drawn at room temperature (20° C.) for 2 to 6 seconds. Table 3 shows the draw ratio.

The drawn and undrawn fibers were exposed to warm air with both ends of the fibers fixed on the drawing machine for heat treatment at 60° C. for 5 minutes. The obtained undrawn fiber of Comparative Example 1 and the drawn fibers of Examples 15 to 20 were measured for breaking strength, elongation to break, and Young's modulus. Table 3 shows the results. The breaking strength, elongation to break, and Young's modulus were measured in accordance with JIS-K6301 using a tensile compression test machine (SV-200 Model, manufactured by Imada Seisakusho Co., Ltd.). The tensile rate was set to 50 mm/min.

The results show that the physical properties of the fibers improve through the process of the present invention.

TABLE 3

Draw ratio and physical properties of amorphous fiber formed by winding fiber extruded at 220° C. (weight average molecular weight of 3,000,000 (number average molecular weight of 1,500,000)) in ice water (drawing using drawing machine, heat treatment with fiber fixed on drawing machine)

| | Drawing process | Drawing temperature (° C.) | Draw ratio (%) | Heat treatment process | Heat treatment temperature (° C.) | Heat treatment time (min) | Breaking strength (MPa) | Elongation to break (%) | Young's modulus (GPa) |
|---|---|---|---|---|---|---|---|---|---|
| Comparative Example 1 | Undrawn | — | — | Drawing machine | 60 | 5 | 19 | 18 | 0.46 |
| Example 15 | Drawing machine | 20 | 250 | Drawing machine | 60 | 5 | 135 | 74 | 1.05 |
| Example 16 | Drawing machine | 20 | 350 | Drawing machine | 60 | 5 | 97 | 24 | 1.45 |
| Example 17 | Drawing machine | 20 | 400 | Drawing machine | 60 | 5 | 269 | 50 | 1.44 |
| Example 18 | Drawing machine | 20 | 450 | Drawing machine | 60 | 5 | 252 | 16 | 3.15 |
| Example 19 | Drawing machine | 20 | 500 | Drawing machine | 60 | 5 | 125 | 34 | 2.06 |
| Example 20 | Drawing machine | 20 | 550 | Drawing machine | 60 | 5 | 115 | 19 | 4.72 |

COMPARATIVE EXAMPLE 2, EXAMPLES 21 TO 24

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB was extruded into ice water for fiber formation.

The fibers obtained in Examples 21 to 24 were set on a drawing machine and were each drawn at room temperature (10° C.) for 4 to 10 seconds. Table 4 shows the draw ratio.

The drawn and undrawn fibers were exposed to warm air with both ends of the fibers fixed on the drawing machine for heat treatment at 100° C. for 3 minutes. The obtained undrawn fiber of Comparative Example 2 and the drawn fibers of Examples 21 to 24 were measured for breaking strength, elongation to break, and Young's modulus. Table 4 shows the results.

The results show that the physical properties of the fibers improve through drawing using a drawing machine and heat treatment with fiber fixed on the drawing machine.

TABLE 4

Draw ratio and physical properties of amorphous fiber formed by winding fiber extruded at 200° C. (weight average molecular weight of 3,000,000 (number average molecular weight of 1,500,000)) in ice water (drawing using drawing machine, heat treatment with fiber fixed on drawing machine)

| | Drawing process | Drawing temperature (° C.) | Draw ratio (%) | Heat treatment process | Heat treatment temperature (° C.) | Heat treatment time (min) | Breaking strength (MPa) | Elongation to break (%) | Young's modulus (GPa) |
|---|---|---|---|---|---|---|---|---|---|
| Comparative Example 2 | Undrawn | — | — | Drawing machine | 100 | 3 | 44 | 15 | 1.19 |
| Example 21 | Drawing machine | 10 | 400 | Drawing machine | 100 | 3 | 152 | 42 | 2.04 |
| Example 22 | Drawing machine | 10 | 600 | Drawing machine | 100 | 3 | 146 | 32 | 2.68 |
| Example 23 | Drawing machine | 10 | 800 | Drawing machine | 100 | 3 | 126 | 123 | 2.20 |
| Example 24 | Drawing machine | 10 | 1000 | Drawing machine | 100 | 3 | 177 | 25 | 2.72 |

EXAMPLES 25 TO 27

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB was extruded into ice water for fiber formation.

The fibers obtained in Examples 25 to 27 were drawn in ice water (3° C.) using a two roll set. Table 5 shows the draw ratio.

The drawn fibers were exposed to warm air with both ends of the fibers fixed on the drawing machine for heat treatment for 5 minutes. Table 5 shows the heat treatment temperature. The obtained drawn fibers of Examples 25 to 27 were measured for breaking strength, elongation to break, and Young's modulus. Tables shows the results.

The results show that the physical properties of the fibers improve through drawing using a two roll set and heat treatment with the fibers fixed on a drawing machine.

TABLE 5

Draw ratio and physical properties of amorphous fiber formed by winding fiber extruded at 200° C. (weight average molecular weight of 3,000,000 (number average molecular weight of 1,500,000)) in ice water (drawing using two roll set, heat treatment with fiber fixed on drawing machine)

| | Drawing process (1) | Drawing temperature (° C.) | Draw ratio (%) | Heat treatment process | Heat treatment temperature (° C.) | Heat treatment time (min) | Breaking strength (MPa) | Elongation to break (%) | Young's modulus (GPa) |
|---|---|---|---|---|---|---|---|---|---|
| Example 25 | two roll set | 3 | 600 | Drawing machine | 110 | 5 | 240 | 74 | 2.51 |
| Example 26 | two roll set | 3 | 800 | Drawing machine | 65 | 5 | 165 | 128 | 1.37 |
| Example 27 | two roll set | 3 | 800 | Drawing machine | 80 | 5 | 199 | 151 | 3.98 |

(1). In ice water, feed rate of 50 rpm, draw winding at wind rate of 300 to 400 rpm

EXAMPLES 28 TO 31

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB was extruded into ice water for fiber formation.

The fibers obtained were set on a drawing machine and were each drawn in room temperature (10° C.) for 7 to 12 seconds. Table 6 shows the draw ratio.

A weight was hung from the drawn fibers and the fibers were exposed to warm for heat treatment at 100° C. for 5 minutes. Table 6 shows the load. The obtained drawn fibers of Examples 28 to 31 were measured for breaking strength, elongation to break, and Young's modulus. Table 6 shows the results.

The results show that the physical properties of the fibers improve through drawing using a drawing machine and heat treatment under load.

TABLE 6

Heat treatment under load and physical properties of amorphous fiber formed by winding fiber extruded at 200° C. (weight average molecular weight of 3,000,000 (number average molecular weight of 1,500,000)) in ice water (drawing using drawing machine, heat treatment under load)

| | Drawing process | Drawing temperature (° C.) | Draw ratio (%) | Heat treatment load (g) | Heat treatment temperature (° C.) | Heat treatment time (min) | Breaking strength (MPa) | Elongation to break (%) | Young's modulus (GPa) |
|---|---|---|---|---|---|---|---|---|---|
| Example 28 | Drawing machine | 10 | 700 | 0 | 100 | 5 | 123 | 128 | 1.23 |
| Example 29 | Drawing machine | 10 | 700 | 40 | 100 | 5 | 293 | 82 | 3.14 |
| Example 30 | Drawing machine | 10 | 700 | 60 | 100 | 5 | 259 | 111 | 4.15 |
| Example 31 | Drawing machine | 10 | 1200 | 30 | 100 | 5 | 427 | 39 | 2.03 |

EXAMPLES 32 AND 33

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB was extruded into ice water for fiber formation.

The obtained fibers were drawn in ice water (3° C.) at draw ratio of 700% using a two roll set.

A weight was hung from the drawn fibers at a load of 40 g, and the fibers were exposed to warm air for heat treatment at 100° C. for 6.5 minutes. The obtained drawn fibers of Examples 32 and 33 were measured for breaking strength, elongation to break, and Young's modulus. Table 7 shows the results.

The results show that the physical properties of the fibers improve through drawing using a two roll set and heat treatment under load.

TABLE 7

Heat treatment under load and physical properties of amorphous fiber formed by winding fiber extruded at 200° C. (weight average molecular weight of 3,000,000 (number average molecular weight of 1,500,000)) in ice water (drawing using two roll set, heat treatment under load)

| | Drawing process (1) | Drawing temperature (° C.) | Draw ratio (%) | Heat treatment load (g) | Heat treatment temperature (° C.) | Heat treatment time (min) | Breaking strength (MPa) | Elongation to break (%) | Young's modulus (GPa) |
|---|---|---|---|---|---|---|---|---|---|
| Example 32 | two roll set | 3 | 700 | 40 | 100 | 6.5 | 183 | 27 | 1.81 |
| Example 33 | two roll set | 3 | 700 | 40 | 100 | 6.5 | 172 | 41 | 2.05 |

(1): In ice water, feed rate of 50 rpm, draw winding at wind rate of 350 rpm

COMPARATIVE EXAMPLES 3 AND 4, EXAMPLES 34 TO 38

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB was extruded into ice water for fiber formation.

The fibers obtained in Examples 34 to 38 were drawn in ice water (3° C.) using a two roll set. Table 8 shows the draw ratio.

The drawn fibers were exposed to warm air to a draw ratio of 300% for heat treatment at 60° C. for 0.5 minute. FIG. 1C is a schematic diagram showing an example of the two roll set used for the operation. The fiber 2 being wound on a wind-up roller 5 is drawn while being wound on the other roller 5 in an oven 6. The fiber can be drawn to a desired draw ratio by changing rates of the two wind-up rollers in such a device.

The undrawn fibers of Comparative Examples 3 and 4 were exposed to warm air with both ends of the fibers fixed on the drawing machine for heat treatment at 60° C. for 5 minutes.

The obtained undrawn fibers of Comparative Examples 3 and 4 and the drawn fibers of Examples 34 to 38 were measured for breaking strength, elongation to breaks and Young's modulus. Table 8 shows the results.

The results show that the physical properties of the fibers improve through drawing using a two roll set and heat treatment.

EXAMPLES 39 TO 42

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB was extruded into ice water for fiber formation.

The obtained fibers were drawn in ice water (3° C.) using a two roll set. Table 9 shows the draw ratio.

A weight was hung from the drawn fibers, and the fibers were exposed to warm air for heat treatment. Table 9 shows the draw ratio, load, heat treatment temperature, and heat treatment time.

The fibers of Examples 41 and 42 at a load of 20 g were further exposed to warm air for a second stage heat treatment at 100° C. for 5 minutes.

The obtained two stage heat treated fibers of Examples 39 to 42 were measured for breaking strength, elongation to break, and Young's modulus. Table 9 shows the results.

The results show that the fibers subjected to two stage heat treatment under load have further improved physical properties compared to those of the fibers subjected to single stage heat treatment.

TABLE 8

Draw ratio and physical properties of amorphous fiber formed by winding fiber extruded at 200° C. (weight average molecular weight of 3,000,000 (number average molecular weight of 1,500,000)) in ice water (drawing using two roll set, heat treatment using two roll set)

| | Drawing process (1) | Drawing temperature (° C.) | Draw ratio (%) | Heat treatment process (2) | Heat treatment temperature (° C.) | Heat treatment time (min) | Breaking strength (MPa) | Elongation to break (%) | Young's modulus (GPa) |
|---|---|---|---|---|---|---|---|---|---|
| Comparative Example 3 | Undrawn | — | — | Drawing machine | 60 | 5 | 203 | 143 | 1.23 |
| Comparative Example 4 | Undrawn | — | — | Drawing machine | 60 | 5 | 110 | 189 | 1.44 |
| Example 34 | two roll set | 3 | 600 | two roll set | 60 | 0.5 | 584 | 46 | 1.95 |
| Example 35 | two roll set | 3 | 600 | two roll set | 60 | 0.5 | 431 | 24 | 3.42 |
| Example 36 | two roll set | 3 | 600 | two roll set | 60 | 0.5 | 371 | 28 | 4.45 |
| Example 37 | two roll set | 3 | 700 | two roll set | 60 | 0.5 | 224 | 93 | 3.32 |
| Example 38 | two roll set | 3 | 800 | two roll set | 60 | 0.5 | 301 | 102 | 1.60 |

(1): In ice waters, feed rate of 50 rpm, draw winding at wind rate of 300 to 400 rpm (2): Rotational speed of rollers adjusted so that draw ratio becomes 300%

TABLE 9

Two stage heat treatment and physical properties of amorphous fiber formed by winding fiber extruded at 200° C. in ice water (weight average molecular weight of 3,000,000 (number average molecular weight of 1,500,000))

| | Drawing process (1) | Drawing temp. (° C.) | Draw ratio (%) | Heat treatment load (g) | Heat treatment temp. (° C.) | Heat treatment time (min) | Second stage heat treatment load (g) | Heat treatment temp. (° C.) | Heat treatment time (min) | Breaking strength (MPa) | Elongation to break (%) | Young's modulus (GPa) |
|---|---|---|---|---|---|---|---|---|---|---|---|---|
| Example 39 | two roll set | 3 | 700 | 40 | 100 | 5 | — | — | — | 183 | 27 | 1.81 |
| Example 40 | two roll set | 3 | 700 | 40 | 100 | 5 | — | — | — | 172 | 41 | 2.05 |
| Example 41 | two roll set | 3 | 800 | 10 | 60 | 3 | 20 | 100 | 5 | 251 | 32 | 1.35 |
| Example 42 | two roll set | 3 | 800 | 10 | 60 | 3 | 20 | 100 | 5 | 255 | 73 | 0.51 |

(1): In ice water, feed rate of 50 rpm, draw winding at wind rate of 350 to 400 rpm

EXAMPLES 43 TO 46

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB fiber was extruded into ice water for fiber formation.

The obtained fibers were drawn to a draw ratio of 800% in ice water (3° C.) using a two roll set.

The drawn fibers were exposed to warm air for heat treatment at 60° C. for 0.5 minute, at a draw ratio of 300% using a two roll set.

The fibers of Examples 45 and 46 were exposed to warm air for second heat treatment at 70° C. for 0.5 minute, at a draw ratio of 0% using a two roll set.

The obtained two stage heat treated fibers of Examples 43 to 46 were measured for breaking strength, elongation to break, and Young's modulus. Table 10 shows the results.

The results show that the fibers subjected to two stage heat treatment have further improved physical properties compared to those of the fibers subjected to single stage heat treatment.

TABLE 10

Two stage heat treatment and physical properties of amorphous fiber formed by winding fiber extruded at 200° C. in ice water (weight average molecular weight of 3,000,000 (number average molecular weight of 1,500,000))

| | Drawing process (1) | Drawing temp. (° C.) | Draw ratio (%) | First stage heat treatment load (2) | Heat treament temp. (° C.) | Heat treatment time (min) | Second stage heat treatment load (3) | Heat treatment temp. (° C.) | Heat treatment time (min) | Breaking strength (MPa) | Elongation to break (%) | Young's modulus (GPa) |
|---|---|---|---|---|---|---|---|---|---|---|---|---|
| Example 43 | two roll set | 3 | 800 | two roll set | 60 | 0.5 | — | — | — | 160 | 87 | 1.63 |
| Example 44 | two roll set | 3 | 800 | two roll set | 60 | 0.5 | — | — | — | 189 | 118 | 1.63 |
| Example 45 | two roll set | 3 | 800 | two roll set | 60 | 0.5 | two roll set | 70 | 0.5 | 263 | 172 | 1.51 |
| Example 46 | two roll set | 3 | 800 | two roll set | 60 | 0.5 | two roll set | 70 | 0.5 | 331 | 82 | 1.86 |

(1): In ice water, feed rate of 50 rpm, draw winding at wind rate of 400 rpm (2): Rotational speed of rollers adjusted so that draw ratio becomes 300%

(3): Rotational speed of rollers adjusted so that draw ratio becomes 0%

EXAMPLES 47 TO 50

Purified PHB having a weight average molecular weight of 3,000,000 (number average molecular weight of 1,500,000) prepared from a genetically modified strain employed in Examples 1 to 8 was used as a sample. The fibers were formed in the same manner as in Examples 1 to 8 except that the melting temperature of PHB was 200° C. and PHB was extruded into ice water for fiber formation.

The obtained fibers were drawn to a draw ratio of 800% in ice water (3° C.) using a two roll set.

The drawn fibers were exposed to warm air for heat treatment at 60° C. for 0.5 minute, at a draw ratio of 300% using a two roll set.

The fibers of Examples 49 and 50 were exposed to warm air for second heat treatment at 60° C. for 0.5 minute, at a draw ratio of 150% using a two roll set.

The obtained two stage heat treated fibers of Examples 47 to 50 were measured for breaking strength, elongation to break, and Young's modulus. Table 11 shows the results.

The results show that the fibers subjected to two stage heat treatment have further improved physical properties compared to those of the fibers subjected to single stage heat treatment.

TABLE 11

Two stage heat treatment (changing wind rate) and physical properties of amorphous fiber formed by winding fiber extruded at 200° C. in ice water (weight average molecular weight of 3,000,000 (number average molecular weight of 1,500,000))

| | Drawing process (1) | Drawing temp. (° C.) | Draw ratio (%) | First stage heat treatment load (2) | Heat treatment temp. (° C.) | Heat treatment time (min) | Second stage heat treatment load (3) | Heat treatment temp. (° C.) | Heat treatment time (min) | Breaking strength (MPa) | Elongation to break (%) | Young's modulus (GPa) |
|---|---|---|---|---|---|---|---|---|---|---|---|---|
| Example 47 | two roll set | 3 | 800 | two roll set | 60 | 0.5 | — | — | — | 160 | 87 | 1.63 |
| Example 48 | two roll set | 3 | 800 | two roll set | 60 | 0.5 | — | — | — | 189 | 118 | 1.63 |
| Example 49 | two roll set | 3 | 800 | two roll set | 60 | 0.5 | two roll set | 70 | 0.5 | 430 | 53 | 4.28 |
| Example 50 | two roll set | 3 | 800 | two roll set | 60 | 0.5 | two roll set | 70 | 0.5 | 449 | 26 | 5.98 |

(1): In ice water, feed rate of 50 rpm, draw winding at wind rate of 400 rpm (2): Rotational speed of rollers adjusted so that draw ratio becomes 300%

(3): Rotational speed of rollers adjusted so that draw ratio becomes 150%

Examples 51 TO 54

Genetically modified *Escherichia coli* XL1-Blue (pSYL105) was prepared and cultured following a process described in JP 10-176070 A, and PHB was obtained from the microbial cells. The weight average molecular weight of the obtained PHB measured following a process described in JP 10-176070 A was 3,000,000 (number average molecular weight of 1,500,000).

The PHB was melted at 200° C., extruded under load into ice water (3° C.) from an extrusion opening, and quenched for fiber formation. The obtained fibers were wound in ice water (3° C.). An extruder used bore was 1 mm. The wind rate was set to 6 m/min.

The obtained fibers were drawn in ice water (3° C.) using a two roll set. Table 12 shows the draw ratio.

The drawn fibers were set on a drawing machine and were each drawn at 20° C. for 6 to 8 seconds. Table 12 shows the draw ratio. FIG. 1D is a schematic diagram showing an example of a device used for the operation. The fiber 2 set on a drawing machine 7 is drawn while being stretched.

The drawn fibers were exposed to warm air with both ends of the fibers fixed on the drawing machine for heat treatment at 70° C. for 5 minutes.

The obtained fibers were measured for breaking strength, elongation to break, and Young's modulus. Table 12 shows the results.

The breaking strength, elongation to break, and Young's modulus were measured in accordance with JIS-K6301 using a tensile compression test machine (SV-200 Model, manufactured by Imada Seisakusho Co., Ltd.). The tensile rate was set to 50 mm/min.

The results show that the physical properties of the fibers improve through the process of the present invention.

TABLE 12

Drawing and physical properties of amorphous fiber formed by winding fiber extruded at 200° C. (weight average molecular weight of 3,000,000 (number average molecular weight of 1,500,000)) in ice water (single stage drawing using two roll set, two stage drawing using drawing machine)

| | Drawing process (1) | Drawing temp. (° C.) | Draw ratio (%) | Second stage drawing (2) | Drawing temp. (° C.) | Draw ratio (%) | Final draw ratio (%) (3) | Heat treatment temp. (° C.) | Heat treatment time (min) | Breaking strength (MPa) | Elongation to break (%) | Young's modulus (GPa) |
|---|---|---|---|---|---|---|---|---|---|---|---|---|
| Example 51 | two roll set | 3 | 600 | Drawing machine | 20 | 800 | 4800 | 70 | 5 | 400 | 51 | 1.00 |
| Example 52 | two roll set | 3 | 800 | Drawing machine | 20 | 600 | 4800 | 70 | 5 | 483 | 51 | 2.46 |
| Example 53 | two roll set | 3 | 800 | Drawing machine | 20 | 600 | 4800 | 70 | 5 | 643 | 62 | 3.22 |
| Example 54 | two roll set | 3 | 800 | Drawing machine | 20 | 700 | 5600 | 70 | 5 | 624 | 36 | 5.57 |

(1): In ice water, feed rate of 50 rpm, draw winding at wind rate of 300 to 400 rpm
(2): Drawing using drawing machine
(3): Product of draw ratio using two roll set and draw ratio using drawing machine

EXAMPLES 55 TO 58

The fibers were formed in the same manner as in Examples 51 to 54 except that the second stage drawing was carried out for each of Examples 55 to 58 at 25° C. for 3 to 10 seconds. Table 13 shows the draw ratio.

The drawn fibers were exposed to warm air with both ends of the fibers fixed on the drawing machine for heat treatment at 50° C. for 5 minutes.

The obtained fibers were measured for breaking strength, elongation to break, and Young's modulus. Table 13 shows the results. The results show that the physical properties of the fibers improve through the process of the present invention.

TABLE 13

Drawing and physical properties of amorphous fiber formed by winding fiber extruded at 200° C. (weight average molecular weight of 3,000,000 (number average molecular weight of 1,500,000)) in ice water (single stage drawing using two roll set, two stage drawing using drawing machine)

| | Drawing process (1) | Drawing temp. (° C.) | Draw ratio (%) | Second stage drawing (2) | Drawing temp. (° C.) | Draw ratio (%) | Final draw ratio (%) (3) | Heat treatment temp. (° C.) | Heat treatment time (min) | Breaking strength (MPa) | Elongation to break (%) | Young's modulus (GPa) |
|---|---|---|---|---|---|---|---|---|---|---|---|---|
| Example 55 | two roll set | 3 | 600 | Drawing machine | 25 | 300 | 1800 | 50 | 5 | 491 | 72 | 2.4 |
| Example 56 | two roll set | 3 | 600 | Drawing machine | 25 | 500 | 3000 | 50 | 5 | 625 | 69 | 4.5 |
| Example 57 | two roll set | 3 | 600 | Drawing machine | 25 | 1000 | 6000 | 50 | 5 | 1320 | 35 | 18.1 |
| Example 58 | two roll set | 3 | 800 | Drawing machine | 25 | 600 | 4800 | 50 | 5 | 650 | 62 | 3.2 |

(1): In ice water, feed rate of 50 rpm, draw winding at wind rate of 300 to 400 rpm
(2): Drawing using drawing machine
(3): Product of draw ratio using two roll set and draw ratio using drawing machine

INDUSTRIAL APPLICABILITY

The present invention can provide: a process for producing a fiber with high strength, and the fiber with high strength produced through the process; and a process for producing a fiber with high strength and high modulus of elasticity and the fiber with high strength and high modulus of elasticity produced through the process, regardless of molecular weights of PHAs varying depending on origins such as a wild type PHAs-producing microorganism product, a genetically modified product, and a chemical product.

The invention claimed is:

1. A process for producing a fiber, comprising: melt-extruding polyhydroxyalkanoic acid; solidifying the polyhydroxyalkanoic acid by quenching it to its glass transition temperature +15° C. or less, to form an amorphous fiber; cold-drawing the amorphous fiber at less than its glass transition temperature; and subjecting the fiber to heat treatment under tension.

2. A process for producing a fiber according to claim 1, wherein the heat treatment is carried out in two stages.

3. A process for producing a fiber according to claim 2, wherein the heat treatment of each stage is carried out at a temperature higher than a temperature of a previous stage.

4. A process for producing a fiber according to claim 1, wherein the heat treatment is carried out under tension using two wind-up rollers.

5. A process for producing a fiber according to claim 1, further comprising drawing the fiber at a glass transition temperature or more after the cold-drawing.

6. A process for producing a fiber according to claim 1, wherein the cold-drawing is carried out under tension using two wind-up rollers.

7. A process for producing a fiber according to claim 1, wherein the polyhydroxyalkanoic acid is poly(3-hydroxybutanoic acid).

* * * * *